US008622716B2

(12) United States Patent
Tanaka et al.

(10) Patent No.: US 8,622,716 B2
(45) Date of Patent: Jan. 7, 2014

(54) OIL-COOLED AIR COMPRESSOR

(75) Inventors: Hideharu Tanaka, Shizuoka (JP); Masahiko Takano, Shizuoka (JP); Akihiro Nagasaka, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 1403 days.

(21) Appl. No.: 12/038,876

(22) Filed: Feb. 28, 2008

(65) Prior Publication Data

US 2009/0087320 A1 Apr. 2, 2009

(30) Foreign Application Priority Data

Sep. 28, 2007 (JP) ..... 2007-253022

(51) Int. Cl.
*F04B 39/06* (2006.01)

(52) U.S. Cl.
USPC ..... 417/228; 417/26; 417/32; 165/122

(58) Field of Classification Search
USPC ..... 417/228, 26, 32, 281, 292; 184/6.22, 184/104.1; 165/122, 244, 245, 247, 165/DIG. 306
See application file for complete search history.

(56) References Cited

U.S. PATENT DOCUMENTS

| | | | | |
|---|---|---|---|---|
| 5,310,020 | A | 5/1994 | Martin | |
| 5,318,151 | A * | 6/1994 | Hood et al. | 184/6.1 |
| 5,718,563 | A | 2/1998 | Hutchinson | |
| 7,059,837 | B2 | 6/2006 | Nichol | |

FOREIGN PATENT DOCUMENTS

| | | |
|---|---|---|
| JP | 6-213186 | 8/1994 |
| JP | 06-213188 | 8/1994 |
| JP | 2000-346215 | 12/2000 |
| JP | 2006-316696 | 11/2006 |
| WO | WO 02/25114 | 3/2002 |

OTHER PUBLICATIONS

Belgium Search Report dated Dec. 17, 2010 with partial English translation.
Chinese Office Action 200810082833.1 dated Dec. 18, 2009 with partial translation.

* cited by examiner

*Primary Examiner* — Charles Freay
*Assistant Examiner* — Philip Stimpert
(74) *Attorney, Agent, or Firm* — Antonelli, Terry, Stout & Kraus, LLP.

(57) ABSTRACT

In an oil-cooled air compressor for controlling a temperature of a lubricant by changing a flow rate of a cooling medium supplied to a heat exchanger for the lubricant, for obtaining an energy saving effect by variable control of the flow rate of the cooling medium and preventing securely a condensed water from occurring in a compressor unit even when an exhaust duct is arranged inappropriately, a lubricant flow rate adjustor is arranged to measure a temperature of the lubricant and decreasing a flow rate of the lubricant supplied to the heat exchanger so that the lubricant temperature becomes T1 to satisfy T0>T1≥TD when T0 is a control temperature of the lubricant and TD is a condensed water occurrence critical temperature at which a condensed water occurs in the compressor.

9 Claims, 2 Drawing Sheets

OIL-COOLED AIR COMPRESSOR

BACKGROUND OF THE INVENTION

The present invention relates to an oil-cooled air compressor.

In the oil-cooled air compressor, there is a provability of that when a temperature of the air discharged from the compressor decreases to not more than a critical temperature in occurrence of condensed water, a water component of the gas is condensed to the water so that a rust is formed in the compressor. Therefore, a lubricant temperature control is important, and in the prior art, a type of the lubricant temperature control in which a flow rate of the lubricant circulating through a heat exchanger is adjusted in accordance with the lubricant temperature measured by a lubricant flow rate adjuster in a lubricant passage is mainly used.

On the other hand, in recent years, an inverter control of cooling fan for cooling the lubricant has been improved for energy-saving and decrease in noise of the cooling fan. This is a type in which a flow rate of a cooling medium supplied to the heat exchanger is adjusted in accordance with the lubricant temperature measured by a temperature sensor or the like, for example, in JP-A-6-213186, a flow rate of cooling air supplied to the heat exchanger for the lubricant is adjusted in accordance with the lubricant temperature measured by the temperature sensor arranged at the lubricant passage to keep the temperature of the lubricant constant so that the condensed water is prevented from being formed in the compressor.

BRIEF SUMMARY OF THE INVENTION

Energy not less than 80% of electric power consumed by the air compressor is discharged from the air compressor as waste energy, for example, energy not less than 80 kW is discharged from the air compressor of 100 kW. Therefore, when the air compressor in which the lubricant is cooled by the atmospheric air as the cooling medium for the heat exchanger is arranged in a closed air compressor room, the heat energy generated by the compressor needs to be discharged from the compressor room through an exhaust duct or the like to keep the temperature in the compressor room desirable.

Generally, the exhaust duct of small flow resistance is required to facilitate a heat energy discharge from the air compressor (exhausting of the cooling fan), but when the exhaust duct has great flow resistance for a reason caused by equip requirement or the like, a ventilation fan needs to be arranged at an outlet port of the exhaust duct.

Incidentally, when the ventilation fan is arranged at the outlet port of the exhaust duct, a clearance between an inlet lower end of the exhaust duct and a exhaust port of the compressor needs to be sufficiently large. When the clearance is in sufficient, the cooling air flows excessively to the heat exchanger for lubricant in comparison with a case where the cooling air flow is generated only by the cooling fan without the ventilation fan, so that an excessive cooling causes the occurrence of the condensed water as a problem.

Further, there is a provability of that mighty wind makes the atmospheric air flow back from an outlet end of the exhaust duct arranged improperly so that the heat exchanger is excessively cooled to cause the occurrence of the condensed water even when the exhaust duct does not include the ventilation fan.

As stated above there is a provability of that the excessive cooling is caused by the arrangement of the air compressor even when the amount of the heat exchange is adjusted to restrain the occurrence of the condensed water in the air compressor. But, the problem caused by an exterior environment as stated above is not considered in JP-A-6-213186.

An object of the present invention achieved with taking the above problem into consideration is to provide an oil-cooled air compressor in which the occurrence of the condensed water is restrained irrespective of the exterior environment surrounding the air compressor.

For achieving the object, as an aspect of the invention, an oil-cooled air compressor comprises a heat exchanger for lubricant and a compressor body compressing air, wherein a flow rate of a cooling medium supplied to the heat exchanger is adjusted continuously to make a temperature of the lubricant not less than a control temperature T0, the compressor further comprises a lubricant flow rate adjustor for measuring the temperature of the lubricant and decreasing the flow rate of the lubricant supplied to the heat exchanger so that the lubricant temperature is made not less than T1, and T0>T1≥TD when TD is a condensed water occurrence critical temperature at which a condensed water occurs in the compressor body. It is preferable that the cooling medium is the atmospheric air.

As another aspect of the invention, an oil-cooled air compressor comprises an oil separator for separating a lubricant and a compressed air from each other, a heat exchanger for cooling the lubricant, a controller for adjusting a flow rate of a cooling medium supplied to the heat exchanger, and a lubricant flow rate adjustor for adjusting a flow rate of the lubricant supplied to the heat exchanger in accordance with a temperature of the lubricant after being separated from the compressed air.

As the other aspect of the invention, an oil-cooled air compressor comprises an oil separator for separating a lubricant and a compressed air from each other, a heat exchanger for cooling the lubricant, a cooling fan for supplying a cooling air to the heat exchanger, and a controller for adjusting a rotational speed of the cooling fan to make the lubricant temperature become T0, wherein the oil-cooled air compressor further comprises a lubricant flow rate adjustor for adjusting a flow rate of the lubricant supplied to the heat exchanger so that the lubricant temperature becomes T1, when a condensed water occurrence critical temperature is TD, and T0>T1≥TD when TD.

In the above aspects, it is preferable that the oil-cooled air compressor further comprises a bypass passage to enable the lubricant after being separated from the compressed air to bypass the heat exchanger so that the flow rate of the lubricant supplied to the heat exchanger is adjusted.

According to the invention, an oil-cooled air compressor in which a condensed water is restrained from occurring irrespective of an environment in which the air compressor is arranged, is provided.

Other objects, features and advantages of the invention will become apparent from the following description of the embodiments of the invention taken in conjunction with the accompanying drawings.

DETAILED DESCRIPTION OF THE INVENTION

Figure 1:
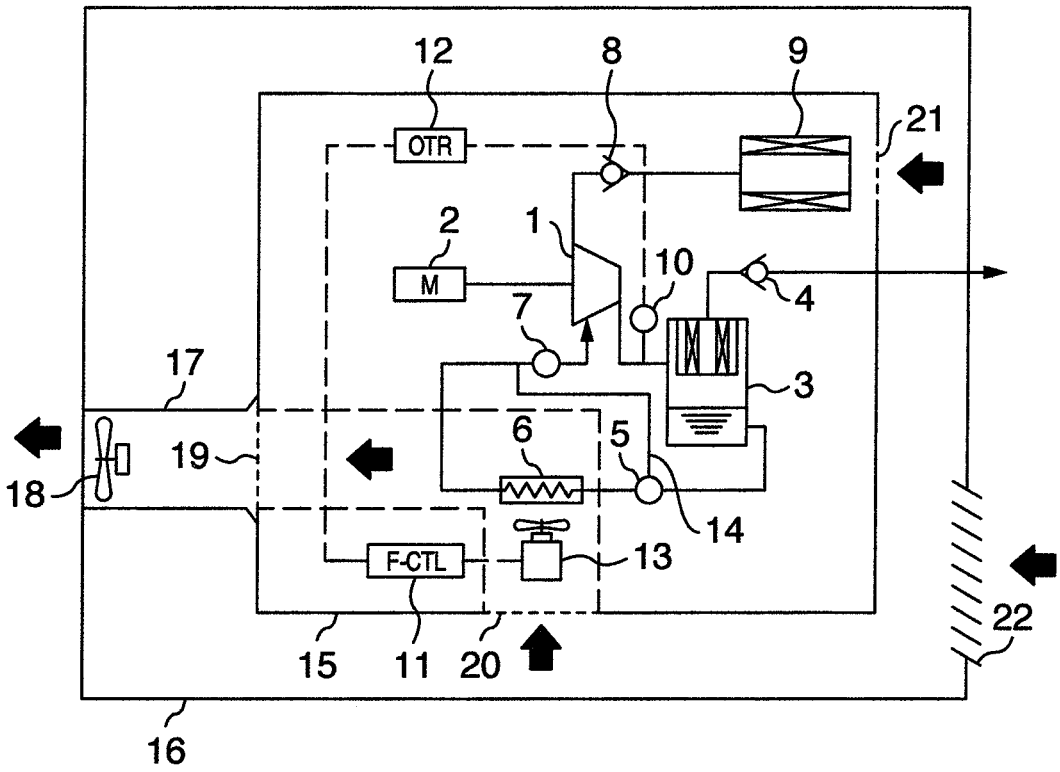
FIG. 1 is a schematic view showing an air compressor arranged in an equipment.

Hereafter, embodiments of the invention will be described with making reference to the drawings. FIG. 1 is a schematic view showing an air compressor arranged in an equipment. This embodiments relates to an air compressor in which a lubricant for cooling a compressed air is cooled by the atmospheric air through a heat exchanger.

A compressor unit 15 of the embodiment as the air compressor in which the lubricant is cooled by the atmospheric air is arranged in a compressor room 16 in an equipment in a factory or the like. A cooling air for cooling the compressor unit 15 is taken into the compressor room 16 from an intake port 22 of the compressor room 16. The compressor unit 15 has an inlet port 20 to take from the inlet port 20 into the compressor unit 15 the cooling air taken into the compressor room 16 from the intake port 22.

The cooling air taken into the compressor unit 15 is fed by a cooling fan to a heat exchanger 6 for lubricant, and is fed out of the compressor unit 15 through an exhaust port 19 of the unit. In the embodiment, an exhaust duct 17 is connected to the exhaust port 19 so that the cooling air is discharged by an ventilation fan 18 through the exhaust duct 17 out of the compressor 16.

In the compressor unit 15, the cooling air is taken from an outside of the compressor room 16 into the unit, and is discharged after cooling an inside of the unit. In FIG. 1, an inlet side of the exhaust duct 17 is arranged at an insufficient distance from the exhaust port 19 of the compressor unit 15 although it should be distant from the exhaust port 19 by more than a predetermined distance.

The compressor unit 15 will be described below. An air to be compressed by the compressor unit 15 is taken from an inlet port 21 through an intake filter 9 and an intake valve 8 into a compressor body 1 driven by a motor 2. The atmospheric air taken into the compressor body 1 is compressed to have a predetermined pressure, and subsequently fed with the lubricant into an oil separator 3. The compressed air separated from the lubricant by the oil separator 3 is fed out of the compressor unit through a check valve 4 to be used for various cases requiring the compressed air.

On the other hand, the lubricant separated from the air by the oil separator 3 is supplied to the compressor body 1 through a circulation path including the heat exchanger 6 for the lubricant and an oil filter 7. A lubricant flow rate adjustor 5 is arranged between the oil separator 3 and the heat exchanger 6 for the lubricant on the circulation path. The lubricant flow rate adjustor 5 adjusts a flow rate of a part of the lubricant which is separated from another part thereof supplied to the heat exchanger 6 for the lubricant and which flows into a bypass passage 14 bypassing the heat exchanger 6 for the lubricant.

Concretely, the lubricant flow rate adjustor 5 has a lubricant temperature sensor to adjust the flow rate of the part of the lubricant flowing to the bypass passage 14 and the flow rate of the another part of the lubricant flowing to the heat exchanger 6 for the lubricant. How to determine the flow rates will be described below.

The control of the lubricant temperature will be described below. A temperature sensor 10 for measuring the lubricant temperature is arranged between the compressor body 1 and the oil separator 3. A controller 12 compares a temperature T measured by the temperature sensor 10 and a target temperature T0. The target temperature T0 is higher than a condensed water occurrence critical temperature TD at which the condenser water occurs in the compressor (TO>TD). The controller 12 outputs to a cooling fan inverter 11 an driving frequency signal to adjust a rotational speed of the cooling fan 13 so that the flow rate of the air supplied to the heat exchanger 6 for the lubricant is adjusted to obtain the target temperature T0.

Concretely, the following control is carried out. When an amount of the air consumed decreases and a load ratio decreases, a heat energy generated by the compressor body 1 decreases so that a temperature of the air discharged from the compressor body 1 decreases. The decrease in temperature of the air discharged from the compressor body 1 is detected by the temperature sensor 10 to decrease the rotational speed of the cooling fan 13 so that the flow rate of the air supplied to the heat exchanger 6 for the lubricant is decreased to make the temperature T of the lubricant close to the target temperature T0. By determining the driving frequency signal of the cooling fan inverter 11 on the basis of the temperature detected by the temperature sensor 10, an amount of the heat exchange at the heat exchanger 6 for the lubricant is adjusted to make the lubricant temperature close to the target temperature T0.

On the other hand, when the exhaust duct 17 is arranged inappropriately as shown in the embodiment, the following problem occurs. That is, even when the flow rate of the air urged by the cooling fan 13 is adjusted by the inverter 11, the arrangement of the exhaust duct 17 causes an increase in flow rate of the cooling air in the compressor unit 15 under an influence of the ventilating fan 18. In such case, the lubricant temperature becomes not more than T0, and when the lubricant temperature reaches the condensed water occurrence critical temperature TD, the condensed water occurs.

Since this phenomenon is caused by that when the cooling fan 13 generates its minimum flow rate, the actual flow rate of the cooling air supplied to the heat exchanger 6 for the lubricant and accelerated by the ventilation fan 18 is more than the flow rate of the cooling air supplied to the heat exchanger 6 for the lubricant by only the cooling fan 13 without the ventilation fan 18 (refer to FIG. 2), the embodiment has the following feature.

That is, while a flow rate of a cooling medium supplied to the heat exchanger 6 for the lubricant is adjusted continuously to make the lubricant temperature not less than the target temperature, and the lubricant flow rate adjustor 5 decreases with measuring the lubricant temperature the flow rate of the lubricant supplied to the heat exchanger 6 for the lubricant to make the lubricant temperature not less than the predetermined temperature T1. Incidentally, T0>T1≥TD.

During a normal operation, as described above, the flow rate of the cooling medium supplied to the heat exchanger 6 for the lubricant is adjusted continuously to make the lubricant temperature not less than T0. In such case, for example, in accordance with the decrease of the load ratio caused by the decrease in flow rate of the air used by the air compressor, the flow rate of the cooling medium (the flow rate of the cooling air urged by the cooling fan 13 in the embodiment) is decreased. When the heat energy exchanged by the heat exchanger is excessively great in the specific condition as the problem such as a case where the flow rate of the cooling medium is minimum, the flow rate of the lubricant supplied to the heat exchanger 6 for the lubricant is decreased by the lubricant flow rate adjustor 5. Therefore, the heat energy exchanged by the heat exchanger is decreased.

By decreasing the exchanged heat energy, in the oil-cooled air compressor, the energy saving by the inverter control for the cooling fan is obtained, and the occurrence of the condensed water as the problem is prevented even when the exhaust duct is arranged in appropriately.

Concretely, the lubricant flow rate adjustor includes the lubricant temperature sensor to easily adjust the flow rate of the lubricant. As the lubricant flow rate adjustor including the lubricant temperature sensor, for example, a valve including a temperature sensor filled with brazing filler to measure the temperature is suitable.

As another embodiment, the temperature sensor such as a thermistor or the like for measuring the lubricant temperature may be arranged on the lubricant passage so that the flow rate of the lubricant supplied to the heat exchanger 6 for the lubricant is decreased to restrain the lubricant temperature from further decreasing when the measured lubricant temperature is low. In this case, the temperature T1 less than T0 and not less than TD may be used as a reference value so that the controller 12 controls the lubricant temperature to be not less than T1.

The adjustment of the flow rate of the lubricant to be supplied to the heat exchanger 6 for the lubricant is performed by the lubricant flow rate adjustor 5 and the bypass passage 14. The lubricant flow rate adjustor 5 adjusts the flow rate by making the lubricant flow through the bypass passage 14 to bypass the heat exchanger in accordance with the temperature measured by the lubricant temperature sensor (the above temperature sensor) to decrease the flow rate of the lubricant circulating through the heat exchanger 6 for the lubricant. That is, the amount of the heat exchange is restrained by the lubricant flow rate adjustor 5 to keep the lubricant temperature not less than T1.

When the consumed flow rate of the air increases to increase the heat energy generated by the compressor body 1, the lubricant flow rate adjustor 5 increases the flow rate of the lubricant circulating through the heat exchanger 6 for the lubricant to keep the lubricant temperature T at T1. When the load ratio further increases and the increase of the lubricant temperature continues so that the lubricant temperature becomes T0 irrespective of that the flow rate of the lubricant circulating through the heat exchanger 6 for the lubricant becomes maximum, the flow rate of the air supplied by the cooling fan 13 to the heat exchanger 6 for the lubricant is increased. In this situation, the control is performed to make the lubricant temperature T become T0.

Although the lubricant flow rate adjustor includes the lubricant temperature sensor in the above embodiment, the lubricant temperature sensor may be arranged on the lubricant passage extending from the oil separator 3 to the compressor 1. Further, the temperature measured by the temperature sensor 10 may be used for the control of the lubricant flow rate adjustor 5 by the controller 12.

Figure 2:
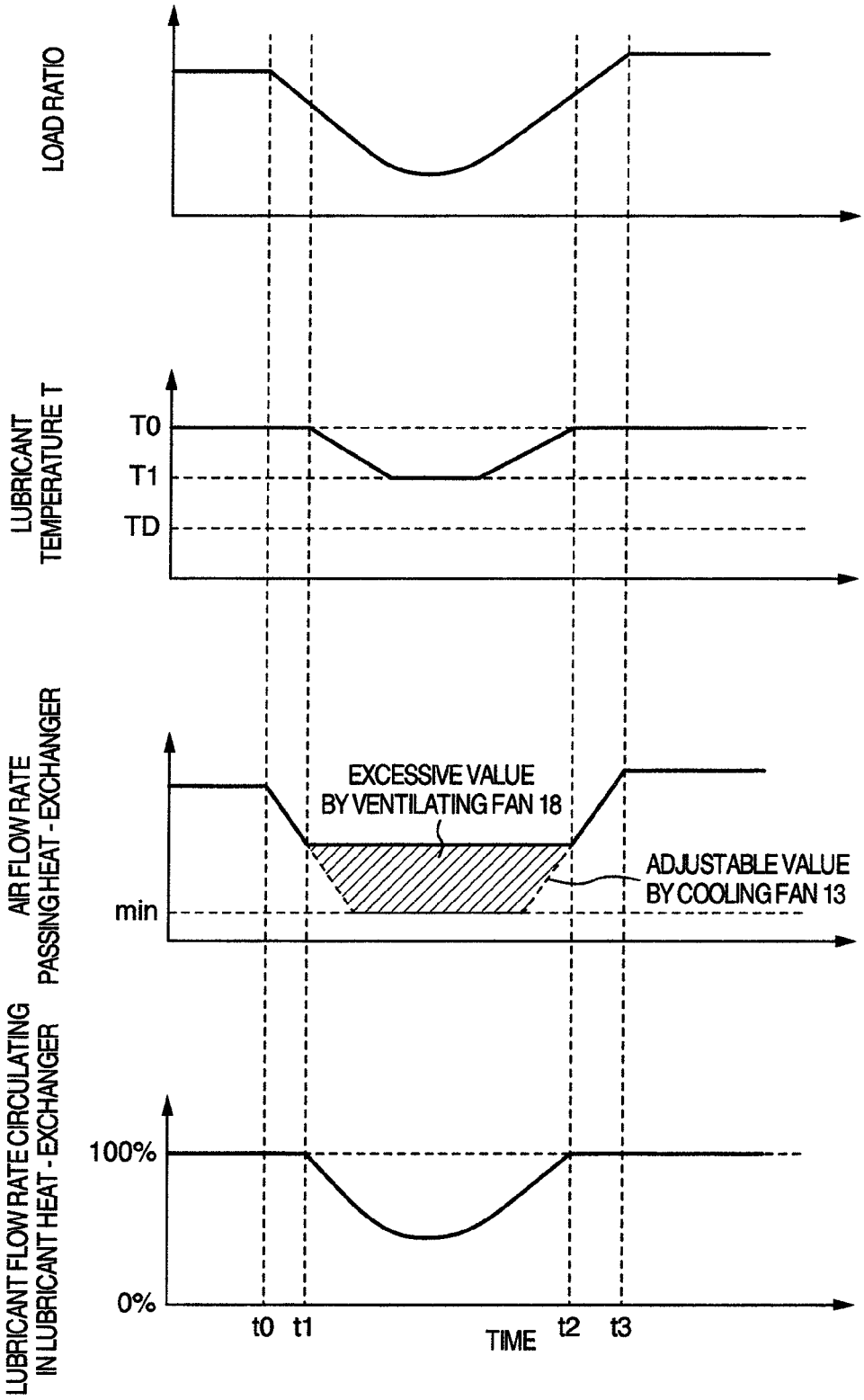
FIG. 2 is a diagram showing conditions under control.

FIG. 2 is a view showing the control in the embodiment. Even when the load ratio, the lubricant temperature can be kept at T0 by adjusting the rotational speed of the cooling fan 12 with the cooling fan inverter 11 (refer to t0-t1). Since the lubricant temperature cannot be kept at T0 and decreases to less than T0 under the influence of the ventilating fan 18 when the load ratio further decreases, the lubricant flow rate adjustor 5 decreases the flow rate of the lubricant circulating through the heat exchanger 6 for the lubricant (refer to t1). In this situation, the flow rate of the lubricant supplied to the heat exchanger is adjusted to make the lubricant temperature become T1.

That is, as shown by dot line in third diagram of FIG. 2, when the excessive flow rate of the cooling air flows on the heat exchanger to make the lubricant temperature less than T0 irrespective of that the rotational speed of the cooling fan 13 decreases to make the flow rate of the cooling air flowing on the heat exchanger minimum, the lubricant flow rate adjustor 5 increases the flow rate of the lubricant flowing through the bypass-passage 14 so that the flow rate of the lubricant flowing through the heat exchanger 6 for the lubricant is decreased to decrease the exchanged heat energy (refer to t1-t2).

Since the lubricant temperature increases again when the load ratio increases, the lubricant flow rate adjustor increases the flow rate of the lubricant circulating through the heat exchanger 6 for the lubricant, and the lubricant flow rate adjustor makes the flow rate of the lubricant circulating through the heat exchanger 100% when the lubricant temperature becomes T0, and control the rotational speed of the cooling fan to keep the lubricant temperature at T0 (refer t2-t3 and time after t3).

As described above, by adjusting the flow rate of the lubricant supplied to the heat exchanger 6 for the lubricant, the lubricant temperature is kept stable to prevent the problem such as the occurrence of the condensed water or the like from occurring, so that the compressor unit operates stably irrespective of the environment in which the compressor is arranged.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An oil-cooled air compressor comprising a heat exchanger for a lubricant and a compressor body compressing air, wherein a flow rate of a cooling medium supplied to the heat exchanger is adjusted continuously to make a temperature of the lubricant not less than a control temperature T0, the compressor further comprises a lubricant flow rate adjustor for measuring the temperature of the lubricant and decreasing the flow rate of the lubricant supplied to the heat exchanger in response to a decrease in the temperature of the lubricant to less than the control temperature T0 after a decrease in a rotational speed of a cooling fan for supplying the cooling medium to the heat exchanger so that the lubricant temperature is made not less than T1, and T0 >T1 ≥TD when TD is a condensed water occurrence critical temperature at which a condensed water occurs in the compressor body, further comprising an exhaust port and a ventilation fan, the ventilation fan being configured to convey the cooling medium through the exhaust port and out of the oil-cooled air compressor.

2. The oil-cooled air compressor according to claim 1, wherein the cooling medium is atmospheric air.

3. The oil-cooled air compressor according to claim 1, wherein a flow of the cooling medium drawn by the ventilation fan may cause the decrease in the temperature of the lubricant to less than the control temperature T0.

4. An oil-cooled air compressor comprising an oil separator for separating a lubricant and a compressed air from each other, a heat exchanger for cooling the lubricant, a cooling fan for supplying a cooling air to the heat exchanger, and a controller for adjusting a rotational speed of the cooling fan to make the lubricant temperature become a control temperature T0, wherein the oil-cooled air compressor further comprises a lubricant flow rate adjustor for adjusting a flow rate of the lubricant supplied to the heat exchanger so that the lubricant temperature becomes T1, when a condensed water occurrence critical temperature is TD, and T0 >T1 ≥TD, and wherein the controller controls the lubricant flow rate adjustor in such a manner that the flow rate of the lubricant supplied to the heat exchanger is decreased in response to a decrease in the temperature of the lubricant to less than the control temperature T0 after the rotational speed of the cool in fan is decreased, while a flow rate of the cooling air flowing on the heat exchanger is minimized by decreasing the rotational speed of the cooling fan, further comprising an exhaust port and a ventilation fan, the ventilation fan being configured to convey the cooling medium through the exhaust port and out of the oil-cooled air compressor.

5. The oil-cooled air compressor according to claim 4, further comprising a bypass passage to enable the lubricant after being separated from the compressed air to bypass the heat exchanger so that the flow rate of the lubricant supplied to the heat exchanger is adjusted.

6. The oil-cooled air compressor according to claim 4, wherein a flow of the cooling air drawn by the ventilation fan may cause the decrease in the temperature of the lubricant to less than the control temperature T0.

7. An oil-cooled air compressor comprising:

a compressor body configured to produce compressed air, the compressor body having an inlet for oil;

a separator configured to separate the oil from the compressed air;

a heat exchanger configured to cool the separated oil by heat exchange with a flow of a cooling medium, the cooled oil being returned to the inlet for the oil;

an oil bypass configured to bypass the heat exchanger and convey the separated oil from the separator to the inlet for the oil; and a controller configured to adjust a temperature of the oil to not less than a control temperature T0 by controlling the flow of the cooling medium, the controller being configured to adjust the temperature of the oil to not less than T1 by increasing an amount of the oil conveyed through the oil bypass in response to a decrease in the temperature of the lubricant to less than the control temperature T0 after a decrease in a rotational speed of a cooling fan configured to supply the cooling medium to the heat exchanger, wherein TD is a critical temperature at which a condensed water occurs in the compressor body, and T0 >T1 ≥TD, further comprising an exhaust port and a ventilation fan, the ventilation fan being configured to convey the cooling medium through the exhaust port and out of the oil-cooled air compressor.

8. The oil-cooled air compressor according to claim 7, wherein the cooling medium is atmospheric air.

9. The oil-cooled air compressor according to claim 7, wherein a flow of the cooling medium drawn by the ventilation fan may cause the decrease in the temperature of the lubricant to less than the control temperature T0.

* * * * *